US006869031B2

(12) United States Patent
Duan

(10) Patent No.: US 6,869,031 B2
(45) Date of Patent: Mar. 22, 2005

(54) SPRAYING NOZZLE FOR REWET SHOWERS

(75) Inventor: Shizhong Duan, Coquitlam (CA)

(73) Assignee: ABB Ltd., Tallaght (IE)

( * ) Notice: Subject to any disclaimer, the term of this patent is extended or adjusted under 35 U.S.C. 154(b) by 168 days.

(21) Appl. No.: 10/429,588

(22) Filed: May 5, 2003

(65) Prior Publication Data

US 2004/0016828 A1 Jan. 29, 2004

Related U.S. Application Data

(62) Division of application No. 10/001,408, filed on Oct. 22, 2001, now Pat. No. 6,699,365.

(51) Int. Cl.[7] ..... A62C 31/00; B05B 7/10; B05B 7/06

(52) U.S. Cl. ..... 239/398; 239/399; 239/403; 239/8; 239/11; 239/416.4; 239/425.5

(58) Field of Search ..... 239/398, 399, 239/403, 8, 11, 416.4, 416.5, 419, 419.5, 424, 425.5

(56) References Cited

U.S. PATENT DOCUMENTS 5,312,046 A * 5/1994 Knoch et al. ..... 239/338
5,687,906 A * 11/1997 Nakagawa ..... 239/8
5,957,389 A * 9/1999 Wunderlich et al. ..... 239/338
6,513,727 B1 * 2/2003 Jaser et al. ..... 239/71

* cited by examiner

*Primary Examiner*—Davis Hwu
(74) *Attorney, Agent, or Firm*—Michael M. Rickin, Esq.

(57) ABSTRACT

A three-stream atomizing nozzle that has an air stream divider that separates the atomizing air from the source into three streams. The first stream is a straight air stream staying closest to and around the atomized water jet. The second stream is a swirl running around the first straight stream. The third stream is also a straight stream that wraps around the first straight stream and the second swirl. The nozzle also has a mixing chamber in which the three air streams are mixed together for the atomizing purpose. From the combination of the three air streams the nozzle can produce fine water droplets that are suitable for many uses and more importantly creates a tailorable water mass profile. The mass profile can be tailored into a shape that is close to a square shape which creates minimal coupling between adjacent zones.

23 Claims, 5 Drawing Sheets

SECTION A-A

SPRAYING NOZZLE FOR REWET SHOWERS

This application is a divisional of application Ser. No. 10/001,408 filed Oct. 22, 2001, now U.S. Pat. No. 6,699, 365.

FIELD OF THE INVENTION

This invention relates to an air atomizing nozzle intended for use with a rewet shower for the paper making industry.

DESCRIPTION OF THE PRIOR ART

A modern paper machine produces paper from a mixture of water and fiber through consecutive processes. Three machine sections named forming, pressing and drying play the most important roles in the making of paper. Pulp at the headbox of the paper machine normally consists of about 1% fiber and 99% water.

The forming section of the paper machine removes water from the pulp by gravity and vacuum suction to form a sheet. In the pressing section, the sheet is conveyed through a series of pressing nips where additional water is removed and the fiber web is consolidated. The water concentration is reduced to about 40% after pressing. The remaining water is further evaporated and fiber bonding develops as the paper contacts a series of steam-heated cylinders in the drying section. The moisture level drops down to about 5 to 10% after the drying section.

One of the important properties of a paper product is the moisture level. However the uniformity of moisture in the paper product in both the machine direction and the cross machine direction is even more important than the absolute moisture level. There are numerous influences on the paper machine that can cause variation of the moisture content, particularly in the cross machine direction. Wet edges and characteristic moisture profiles are common occurrences on paper sheets produced by a paper machine. Therefore a number of actuator systems have been developed to offer control of the moisture profile during paper production.

One such actuator system is a water rewet shower that selectively adds small water droplets onto the paper surface. The rewet showers, which are commercially available, employ actuator nozzle units that are mounted in sequential segments (or zones) across the paper machine direction. Water flow rate is controlled independently through each actuator nozzle unit. Hence the moisture profile on the paper sheet can be adjusted by the rewet system. Spray nozzles are normally used in those rewet showers to generate droplets small enough to produce effective rewetting.

One significant component in a rewet shower is the nozzle. Droplet sizes and water mass profiles across the nozzle jets are the most important parameters to evaluate the feasibility of a particular nozzle for a rewet shower. Water particles too small tend to evaporate before they can reach the paper sheet. Droplets too big can hardly produce uniformity on the paper sheet and in extreme cases they may cause problems such as strips on the web. The ideal mass profile for the paper rewet shower generated from a single nozzle is a square shape. The width of the square determines the zone size of the rewet shower. The height of the square represents the moisture added through this single nozzle. The coupling effects between adjacent nozzle jets are minimal in this ideal case.

Two kinds of nozzles, hydraulic and air atomizing, are widely used for water sprays. A hydraulic nozzle uses energy from a highly pressurized source to break water into droplets at the nozzle. The flow rate passing through a hydraulic nozzle is a function of the source pressure. The spraying pattern, such as spraying angle and velocity profile, is affected by the pressure as well. The fact that the droplet size is related to the flow rate makes the hydraulic nozzle ideal for operation at a fixed design point.

An air-atomizing nozzle uses energy from pressurized air to break water into small droplets. Two types of atomizing nozzle are in wide use. The internal-mixing-type nozzles mix atomizing air with water within a mixing chamber before emitting the droplet. The dependence of water flow rate on the pressure of atomizing air makes this type of nozzle unsuitable for rewet showers. The external-mixing-type nozzles mix the water with the atomizing air in an opening area outside the nozzle. The water flow rate of external-mixing-type nozzles is independent of the atomizing air pressure. The spray patterns of the external-mixing-type nozzle are affected mostly by air pressure. The droplet size from an external-mixing-type nozzle depends more on the air pressure than the water flow rate. Separating droplet size and profile controls from water flow rate control substantially simplifies the controlling strategy of a spraying system. The characteristics of the external-mixing-type nozzle make this kind of nozzle most suitable for paper rewet applications.

A simple example of an externally mixing nozzle consists of a tube surrounded by an annulus as is described by M. Zaller and M. D. Klem in "Coaxial Injector Spray Characterization Using Water/Air as Simulants", $28^{th}$ JANNAF Combustion Subcommittee Meeting, CPIA Publication 573, vol. 2, pp151–160 ("Zaller et al."). The water flows within the tube, and the atomizing air flows in the annulus surrounding the tube in the direction parallel to the water stream. As is described in Zaller et al. this nozzle configuration can produce water droplets less than 50 microns. However the drawback of this simple nozzle is the mass profile which takes a relatively sharp peak at the center of the nozzle jet as shown in FIG. 1 by the profile labeled "Single Stream." The pulse-shaped single stream profile limits the zone size of the rewet shower.

With the same nozzle geometry as described in Zaller et al., one can introduce swirling flow in the annulus surrounding the water tube. The atomizing air moves in a direction substantially perpendicular to the water stream. German Patent No. 952,765 describes one of the "single stream" nozzles that uses a swirl to break the water into droplets. The swirl generates relatively larger particles compared to the straight flow assuming that the same air pressure is employed. The drawback of the "single swirl" nozzle of German Patent No. 952,765 is that the mass profile has a recess in the center aligned with the nozzle and two peaks on both sides of the recess as is shown in FIG. 1 by the profile labeled "Single Swirl."

U.S. Pat. No. 4,946,101 which is owned by the owner of German Patent No. 952,765 discloses an apparatus combining a straight stream and a swirl in the annulus surrounding the water tube. A swirling member with square threads is used to produce the required swirling flow. The combined straight and swirling flows break the water into small droplets. Centrifugal force generated from the swirl acts on water droplets and pushes them away from the center of the jet. The peak from the straight stream compensates the recess created from the swirling flow. The resulting mass profile has a relatively flat portion in the center of the jet and two relatively steep slopes on both edges as shown in FIG. 1 by the profile labeled "Stream-Swirl Combination."

The present invention adds to the combined straight and swirling stream another straight stream outside of and surrounding the swirling stream. One of the purposes of adding another straight stream is to add axial momentum to the particles at the outer region of the swirl which makes the slopes on the edges steeper. The resulting water profile (shown in FIG. 1 by the profile labeled "Stream-Swirl-Stream Combination") created by the combination of the three atomizing air streams is closer to a square in shape than that generated from the combination of a straight stream and a swirl.

In the atomizing nozzle of the present invention a combination of three air streams is used to break the water into small droplets. A water stream with relatively low velocity is located in the center of the nozzle jet. A main air stream moving straight in the same direction as the water stream is located around the water stream. This main air stream moves much faster than the water flow inside the water stream. The shearing force generated by the large velocity gradient at the boundary of the two steams is the major force to break the water into small particles. As is described in Zaller et al. this major air stream delivers droplets less than 50 microns which is suitable for paper rewet applications. However most of the water droplets generated from this single air stream are distributed around the center of the jet. The concentrated distribution of water mass substantially limits the zone size of a rewet shower.

In order to widen the water mass profile, an air swirl that moves around the axes of both the water stream and the major air stream could be added. As is well known, the pressure outside of the swirl should be larger than the pressure inside of the swirl to maintain the circular movement of the air. The force acting on a small volume of air generated from the pressure gradient points to the center of the swirl and balances the centrifugal force acting on the same volume that points outward from the swirl's center. Because water droplets tend to follow the air in the swirl, and the water is almost 1000 times heavier than air, the centrifugal force acting on a water droplet is about 1000 times of that of the centrifugal force acting on air occupying the same volume of the droplet.

Meanwhile the existence of water droplets in the swirl has little effect on the pressure distribution in the swirl. The outbalance between the pressure force and centrifugal force acting on a particular droplet results in a force that pushes the particle away from the swirl's center. Adding a swirl can substantially reshape the water mass distribution. The resulting water mass distribution produced from both the major air stream and the swirl is much wider than that produced by a single major air stream as is shown in FIG. 1 by the profile labeled Stream-Swirl Combination. Although the two-stream nozzle is useful for the paper rewet application it has a drawback. The water droplet mass profile produced by a two-stream nozzle cannot be adjusted or tailored, especially at the outer edges of the profile.

The ideal water droplet mass profile of a nozzle jet for paper rewet applications is a square profile. It is the nature of a swirl that the axial momentum is weaker than the tangential momentum. Therefore the axial momentum at the outer region of the swirl is comparatively less than that in the inner region of the swirl considering there is a major air stream in the inner region. The weak axial momentum around the swirl allows water droplets to float around the swirl and never get a chance to reach the paper to be wetted. I have found that this water droplet action can be resolved by adding another straight stream outside and around the swirl. The third air stream basically pushes more water droplets at the outer region of the swirl to the paper sheet, and in combination with the swirl and the other straight stream makes the water mass distribution more like a square as shown in FIG. 1 by the profile labeled Stream-Swirl-Stream Combination.

One of the advantages of the three-stream nozzle of the present invention is to allow users to tailor the shape of the mass profile produced by the nozzle. The combination of the three streams used for atomizing purpose can be prepared and adjusted according to specific requirements on the resulting shape of the mass profile. The strength of the swirl affects mostly the width of the resulting mass profile. The inner straight stream compensates the recess in the middle of the mass profile associated with the swirling flow. The outer straight stream can be used to reshape the edges of the resulting mass profile as required.

SUMMARY OF THE INVENTION

An apparatus for atomizing a liquid with a gas. The apparatus comprises:

a) a housing having a gas discharging outlet and a liquid discharging outlet aligned flush with each other;

b) a first nozzle in the housing for producing at the gas discharging outlet and along a predetermined axis a mixed gas stream that is the combination of a gas stream that has a swirling movement around the predetermined axis, a first gas stream moving straight in the direction of the axis in the inner portion of the swirling stream and a second gas stream also moving straight in the direction of the axis and wrapping around the swirling stream and the first gas stream;

c) a second nozzle disposed in the first nozzle for producing at the liquid discharging outlet a controlled stream of liquid; and d) a gas stream divider disposed in the first nozzle and outside of the second nozzle, the gas stream divider maintaining the concentricity of the mixed gas stream and the controlled liquid stream.

An apparatus for atomizing a liquid with a gas. The apparatus comprises:

a) a first nozzle for producing in the apparatus and along a predetermined axis a mixed gas stream that is the combination of a gas stream that has a swirling movement around the predetermined axis, a first gas stream moving straight in the direction of the axis in the inner portion of the swirling stream and a second gas stream also moving straight in the direction of the axis and wrapping around the swirling stream and the first gas stream;

b) a second nozzle disposed in the first nozzle for producing in the apparatus a controlled stream of liquid; and c) a gas stream divider disposed in the first nozzle and outside of the second nozzle, the gas stream divider maintaining the concentricity of the mixed gas stream and the controlled liquid stream.

In a nozzle, a method for atomizing a liquid with a gas. The method comprises:

(a) forming a mixed gas stream that is the combination of a gas stream that has a swirling movement about a predetermined axis, one gas stream moving straight in the direction of the axis in the inner portion of the swirling stream and another gas stream also moving straight in the direction of the axis the another gas stream wrapping around the swirling stream and the one straight gas stream; and (b) supplying a flow of liquid into the formed gas stream so that the flow of liquid is atomized by the mixed gas stream.

A method for atomizing a liquid with a gas. The method comprises:

(a) forming a mixed gas stream that is the combination of a gas stream that has a swirling movement about a predetermined axis, one gas stream moving straight in the direction of the axis in the inner portion of the swirling stream and another gas stream also moving straight in the direction of the axis the another gas stream wrapping around the swirling stream and the one straight gas stream;

(b) atomizing a flow of liquid with the formed gas stream to produce fine droplets of the liquid; and (c) adjusting at least one of the swirling gas stream, the one gas stream and the another gas stream in the mixed gas stream so that the droplets have a predetermined mass distribution profile.

In a nozzle for atomizing a liquid with a gas, the nozzle having an outlet. The nozzle comprises:

(a) a gas stream divider for dividing a gas stream entering the nozzle into a swirling gas stream that has a swirling movement about a predetermined axis, one gas stream moving straight in the direction of the axis in the inner portion of the swirling stream and another gas stream also moving straight in the direction of the axis; and (b) a chamber for mixing the swirling stream, the one straight stream and the another straight stream to produce in the nozzle a mixed gas stream that is the combination of the swirling stream, the one straight gas stream and the another straight gas stream, the another straight gas stream wrapping around the swirling stream and the one straight gas stream.

An apparatus comprising:

an array of nozzles for atomizing a liquid with a gas, each of the nozzles having an outlet and each of the nozzles comprising:

(i) a gas stream divider for dividing a gas stream entering the nozzle into a gas stream that has a swirling movement about a predetermined axis, one gas stream moving straight in the direction of the axis in the inner portion of the swirling stream and another gas stream also moving straight in the direction of the axis; and (ii) a chamber for mixing the swirling stream, the one straight stream and the another straight stream to produce in the nozzle a mixed gas stream that is the combination of the swirling stream, the one straight gas stream and the another straight gas stream, the another straight gas stream wrapping around the swirling stream and the one straight gas stream.

An apparatus comprising:

an array of nozzles for atomizing a liquid with a gas, each of the nozzles having an outlet and each of the nozzles comprising:

(i) a gas stream divider for dividing a gas stream entering the nozzle into a gas stream that has a swirling movement about a predetermined axis, one gas stream moving straight in the direction of the axis in the inner portion of the swirling stream and another gas stream also moving straight in the direction of the axis;

(ii) a chamber for mixing the swirling stream, the one straight stream and the another straight stream to produce in the nozzle a mixed gas stream that is the combination of the swirling stream, the one straight gas stream and the another straight gas stream, the another straight gas stream wrapping around the swirling stream and the one straight gas stream; and (iii) a flow of liquid atomized by the mixed gas stream; and a web of a hygroscopic material advancing across the array of nozzles.

DESCRIPTION OF THE PREFERRED EMBODIMENT(S)

The present invention uses the combination of three air streams in an atomizing nozzle to break the water into small droplets and produce a nearly square-shaped mass profile that is suitable for paper rewet applications. The nozzle configuration is shown in the actuator nozzle unit 10 of FIG. 2.

Figure 2:
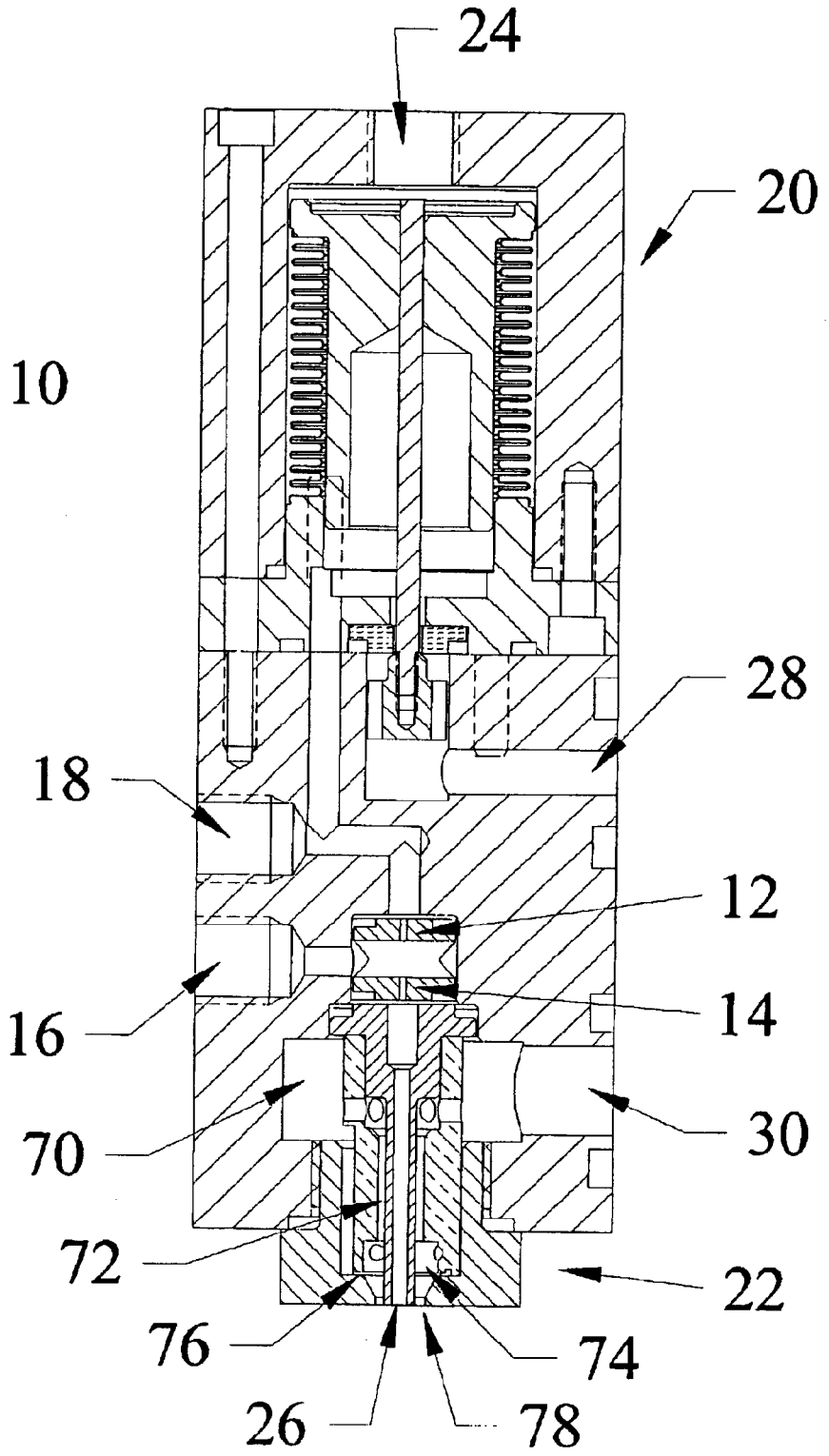
FIG. 2 shows an actuator nozzle unit that includes the air-atomizing nozzle of the present invention.

The nozzle 22 has one port 28 connecting to a source of water not shown in FIG. 2 and another port 30 connecting to a source of pressurized atomizing air not shown in FIG. 2. Water from the port 28 is regulated by the regulator-type actuator 20 based on a pneumatic control signal at port 24. The regulated water passing through the two orifices 12 and 14 in series flows into the center orifice 26 of the nozzle to form a jet.

The atomizing air in channel 70 is divided into three streams. One of the air streams passes through the gap 72 and staying close to and around the water stream emitting from nozzle orifice 26 forms the major air stream. Another air stream flows tangentially into the mixing chamber 74 and forms a swirl outside the major straight air stream. The third air stream passes through the gap 76 and stays against the solid wall 90.

The three streams, mixed in the mixing chamber 74, rush out the annulus 78 around the water orifice 26. The atomizing air streams move much faster than does the inside water jet. The shearing force generated by this large velocity gradient among the streams breaks the water into small droplets. Water particles with a size less than 50 microns in diameter can be expected from the nozzle 22. The actuator nozzle unit 10 can be used alone or mounted on a common manifold in an array for applications such as a rewet shower.

In addition to the novel atomizing nozzle used in the actuator nozzle unit 10, there are two techniques involved in this actuator nozzle unit that need a brief description before one can understand how the actuator nozzle unit 10 works. One technique is the regular-type bellows actuator described in U.S. patent application Ser. No. 09/712,417 filed on Nov. 14, 2000 for "Bellows Actuator For Pressure And Flow Control", the disclosure of which is incorporated herein by reference, that is used to control the water flow rate through the actuator nozzle unit 10. The other technique is the double orifice described in U.S. patent application Ser. No. 09/824,113 filed on Apr. 2, 2001 for "Flow Monitor For Rewet Showers, the disclosure of which is incorporated herein by reference, that is used to monitor the status of the flow control orifices and the nozzle orifice. Each of these techniques are described below.

Figure 1:
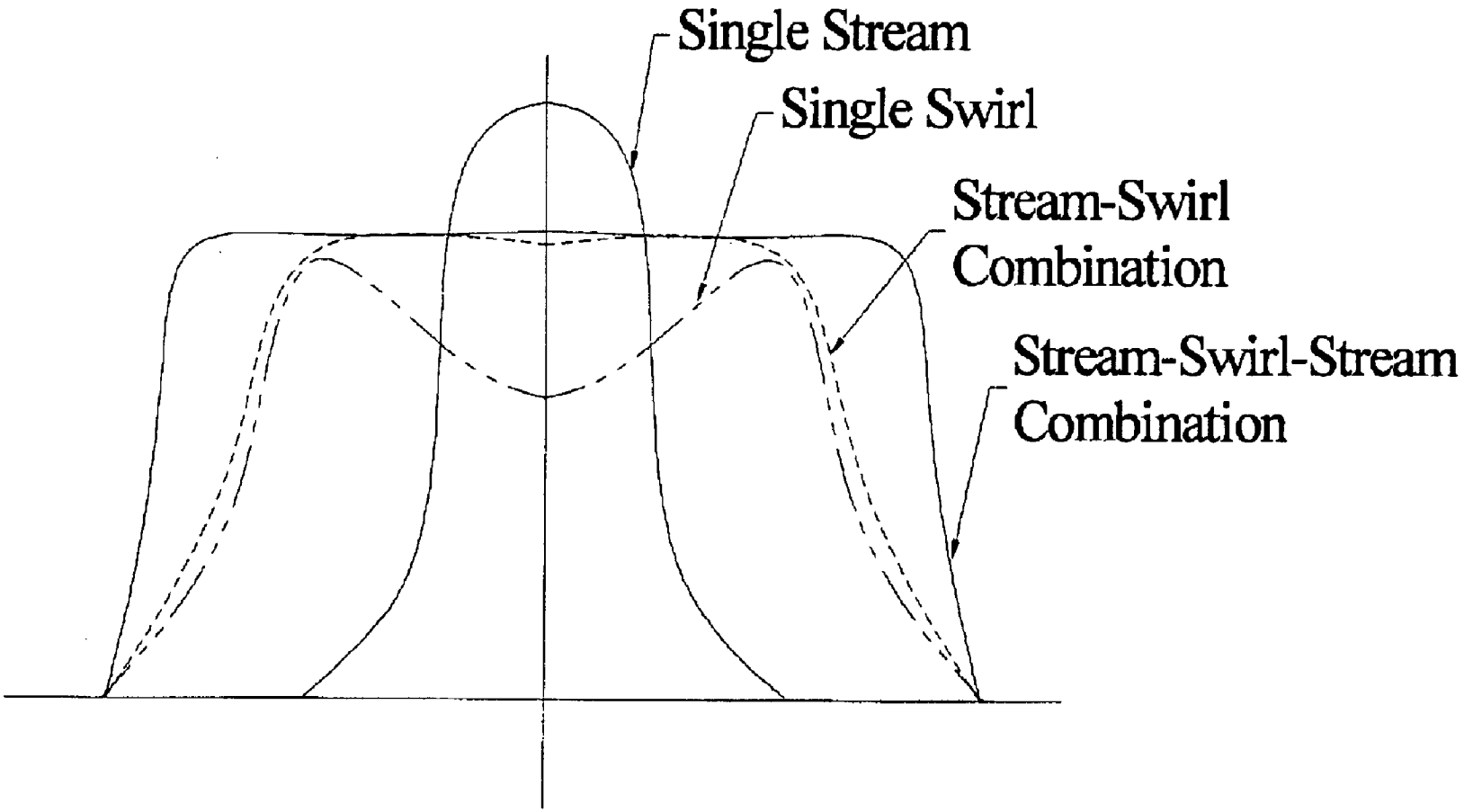
FIG. 1 shows the water mass profiles that a paper sheet receives created by various atomizing nozzles including the nozzle of present invention.
Figure 3:
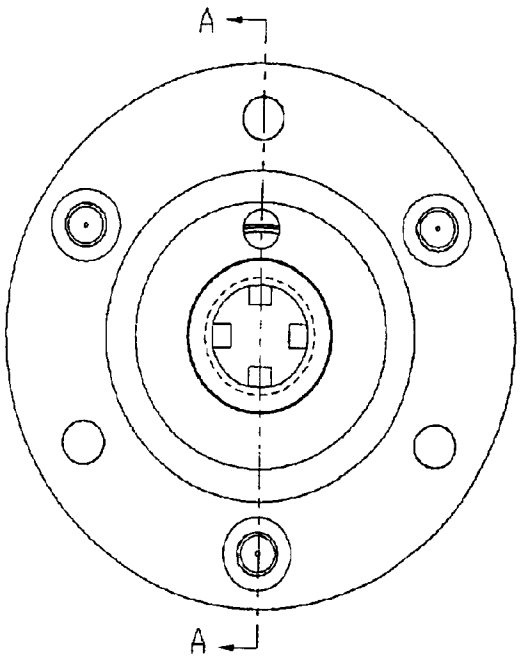
FIG. 3 shows an embodiment for the regulator type actuator that is part of the actuator nozzle unit of FIG. 2.
Figure 3:
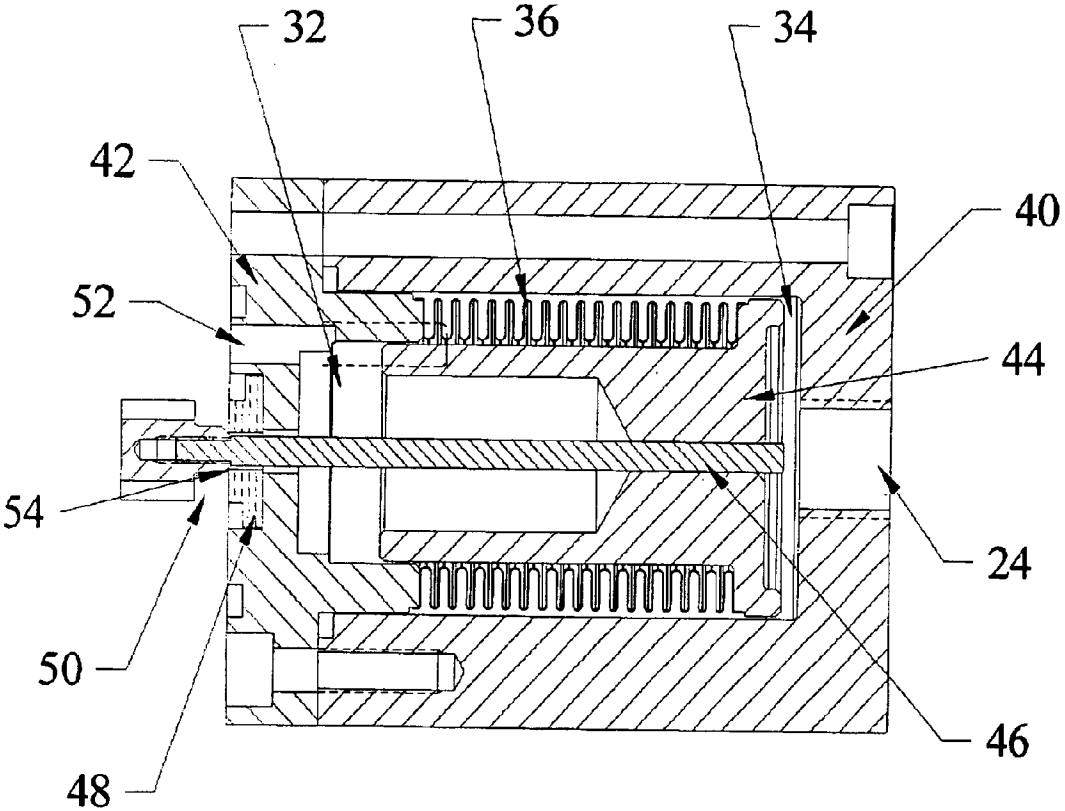

Referring now to FIG. 3 there is shown an embodiment for the regulator-type actuator 20 of FIG. 1. Actuator consists of an internal chamber 32 and an external chamber 34 separated by a flexible metal bellows 36. The external chamber 34 is formed by the air inlet containment cup 40, the bellows 36, the water inlet end piece 42 and the piston 44. The control air inlet 24 feeds into the external chamber 34. The internal chamber 32 is formed by the water inlet end piece 42, the bellows 36 and the piston 44. The source water inlet 50 feeds into the internal chamber 32. A valve stem 46 attached to the piston 44 with a valve seat 48 forms a valve at the source water inlet 50. A spray water outlet 52 directs the water to the double orifices 12 and 14 and the nozzle orifice 26 which are shown in FIG. 2 and are part of the nozzle portion of unit 10.

Initial setup of the actuator 20 involves compressing the metal bellows 36 a predetermined amount and attaching the valve stem 46 such that the valve orifice 54 is closed at this pre-compressed setting. In addition, the water inlet end piece 42 and the piston 44 are designed to diametrically guide each other in their relative movement as well as act as an anti-squirm guide for the bellows 36.

The actuator 20 works to control the pressure fed to the double orifices 12 and 14 and the nozzle orifice 26 using the pneumatic control air pressure as a reference. Source water is fed to the source water inlet 50 at a pressure in excess of the maximum desired pressure for the spray nozzle 22. Control air is fed to the metal bellows 36 through the air inlet containment cup 40.

The air pressure in the external chamber 34 acts against the effective area of the bellows 36 and creates an operating force, which is resisted by three opposing forces. The first opposing force is formed by the spring action of the pre-compressed metal bellows 36. The second opposing force is formed by the pressure of the source water acting against the relatively small area of the valve orifice 54 opening. The third opposing force is formed by the spray water pressure in the internal chamber 32 acting against the effective area of the bellows 36. The first two reactive forces are substantially small or constant which allows changes to the control air pressure to predictably affect the pressure of the water feeding the double orifices 12 and 14 and the nozzle orifice 26. The actuator 20 operates on a balance of these forces.

If the control air pressure is less than the kickoff pressure, determined by the amount of pre-compression of the bellows 36, the valve stem 46 remains against the valve seat 48 and no water passes through the valve orifice 54. The double orifices 12 and 14 and nozzle orifice 26 downstream receive no water pressure to feed them.

When the control air pressure exceeds the kickoff pressure of the actuator 20, the valve stem 46 is pushed down by the piston and water flows through the valve orifice 54 into the internal chamber 32 and out to the double orifices 12 and 14 and nozzle orifice 26. The double orifices 12 and 14 and the nozzle orifice 26 downstream allow water flow through it but also offer resistance to such flow. Thus the pressure in the internal chamber 32 builds. As the pressure in the internal chamber 32 increases, the sum of the opposing forces increase until it matches the force of the control air pressure in the external chamber 34. A balance point between control force and reactive opposite forces results in a determined flow rate passing through the double orifices 12 and 14 and the nozzle orifice 26.

The monitoring capability of this actuator nozzle unit 10 is achieved by pressure measurement at two pressure ports. As is shown in FIG. 2 there is a pressure port 16 located right between the two orifices 12 and 14. There is also another pressure port 18 upstream of the two orifices 12 and 14 that monitors the regulated water pressure from the actuator 20 included in the unit 10. The upstream pressure measured is compared with the pneumatic control pressure sent to the actuator 20 through port 24. This comparison results in the performance diagnosis of the actuator 20.

The pressure measured between the two orifices 12 and 14 in combination with the pressure measured upstream can be used to monitor the status of the double orifices 12, 14 and the water orifice 26. Orifice monitoring is achieved by using a double orifice technique. The double orifice technique is based on the fact that there is always a pressure drop when a moving fluid passes an orifice. The pressure change at port 16 between the orifices 12 and 14 is monitored over time under a constant upstream pressure at port 18. The pressure between the double orifices 12, 14 should be a portion of the upstream pressure, and the ratio between the two pressures is a constant if there is no geometrical variation in the flow passage.

If the upstream orifice 12 of the double orifices is partially blocked, the measured pressure between the double orifices 12 and 14 will be lower than normal. A zero pressure measurement between the orifices 12 and 14 indicates full blockage at the upstream orifice 12 during normal operation. When wearing occurs to the upstream orifice 12, increasing pressure should be expected between the double orifices 12 and 14. Similarly, a blockage at the downstream orifice 14 or the water nozzle 26 resists the flow more and consequently a higher pressure should occur between the orifices 12 and 14. When the downstream orifice 14 is fully blocked, the pressure between the two orifices 12 and 14 equals the upstream pressure. Downstream orifice wearing results in a pressure drop.

In short, a pressure drop between the orifices 12 and 14 indicates either blockage at the upstream orifice 12 or wearing downstream. Pressure increasing between the orifices 12 and 14 implies that there is either wearing at the upstream orifice 12 or blockage downstream. Although there is no way to tell which orifice has caused the variation in the measured pressure one should be able to conclude that it is time to change the orifices. The double orifices 12 and 14 can be designed as one component for easy replacement.

In a practical rewet shower with an array of the actuator nozzle units 10 discussed above, data for each actuator nozzle unit 10 should be recorded during the initial setup of the rewet system. The data includes pressure readings at port 16 and 18 against each possible pneumatic control signal at port 24. This data can be used as a reference later on during normal operation to check the status of the double orifices 12 and 14 or nozzle orifice 26, and the performance of the regulator-type actuator 20 as well.

At any time during normal operation, the control signal at port 24 and corresponding pressure readings from port 16 and port 18 can be acquired and then compared to the recorded data. If the pressure reading from port 18 does not match with the normal value, the regulator-type actuator is malfunctioning. A discrepancy between the pressure reading at port 16 and the recorded normal value indicates problems at the double orifices 12 and 14 or nozzle orifice 26.

The nozzle orifice 26, which affects the droplet size from the nozzle 22, is the same for all applications. Orifice diameters of the double orifices 12, 14 determine the maximum water flow capacity for each individual application. For most of the applications, the nozzle orifice 26 is much larger than the flow orifice diameter. Therefore the pressure drop through the water orifice 26 is substantially less than the pressure drop through any one of the two orifices 12, 14. A relatively large pressure value at the port 16 makes precise pressure measurement there easier. That is why the monitoring technique uses two orifices 12, 14 instead of one in the design. In practice, the diameters of the two orifices 12, 14 can be either identical or different.

Figure 4:
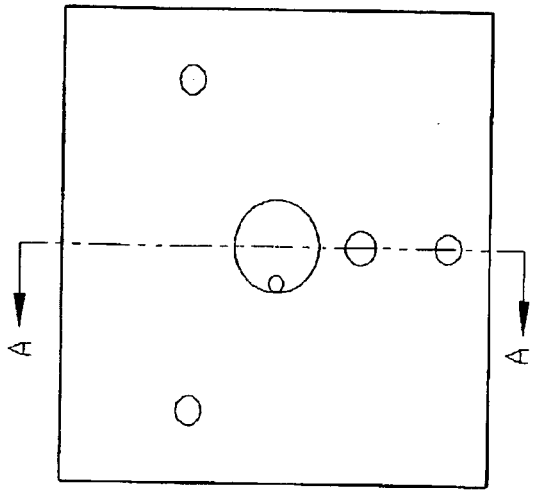
FIG. 4 shows an embodiment for the nozzle portion of the actuator nozzle unit of FIG. 2.
Figure 4:
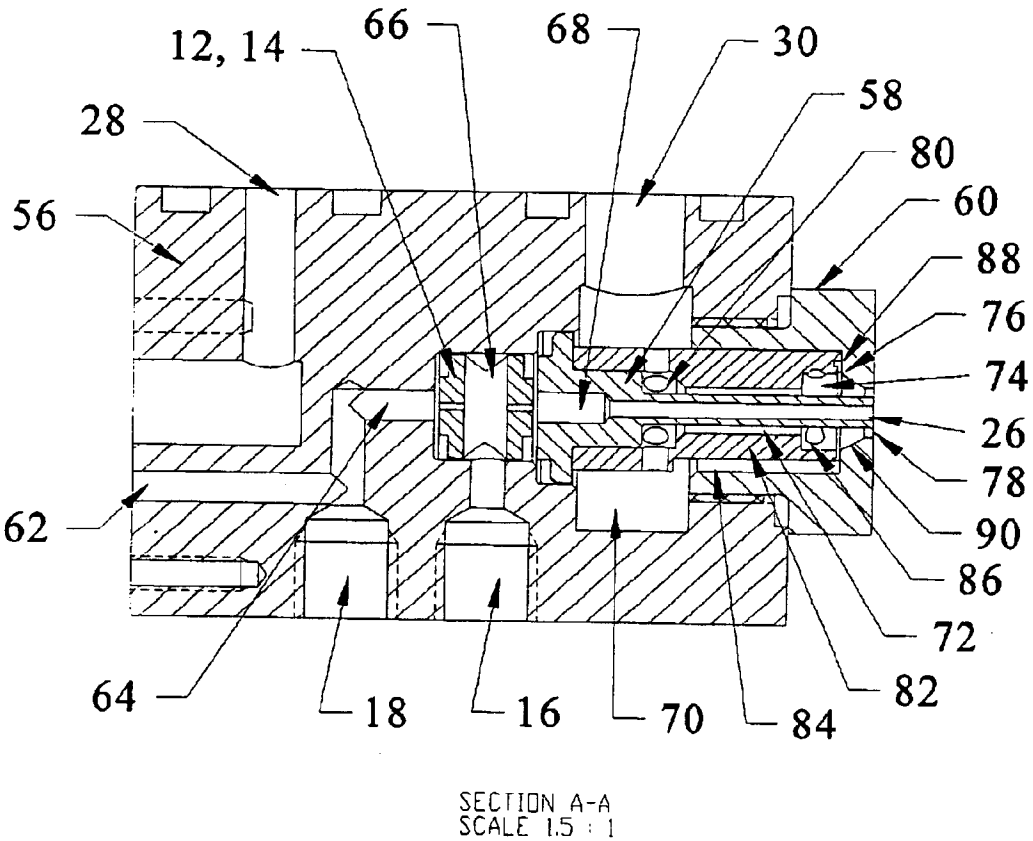

Referring now to FIG. 4 there is shown an embodiment for the nozzle portion of the actuator nozzle unit 10. The nozzle portion consists of a nozzle body 56, the double orifices 12 and 14, a water nozzle tube 58, an air stream divider 82 and an air cap 60. The nozzle body 56 also serves as a mounting base for the actuator 20. The source water inlet 28 on the nozzle body 56 is connected to the source water inlet 50 to the actuator 20. The spray water outlet 52 from the actuator 20 is aligned with the regulated water inlet 62 on the nozzle body 56.

There are three chambers 64, 66 and 68 along the water flow passage in the nozzle body 56. The pressure port 18 is connected to the upstream chamber 64 formed by the nozzle body 56 and the double orifices 12 and 14. The pressure port 16 is connected to the middle chamber 66 between the double orifices 12 and 14 and is surrounded by the nozzle body 56. The double orifices 12 and 14 and the water nozzle tube 58 form the third or downstream chamber 68.

Water from the actuator 20 feeds into the upstream chamber 64, gushes into the middle chamber 66 by passing through the upstream orifice 12, enters the downstream chamber 68 by passing through the downstream orifice 14 and finally flows through the nozzle orifice 26 of the water nozzle tube 58.

Figure 5:
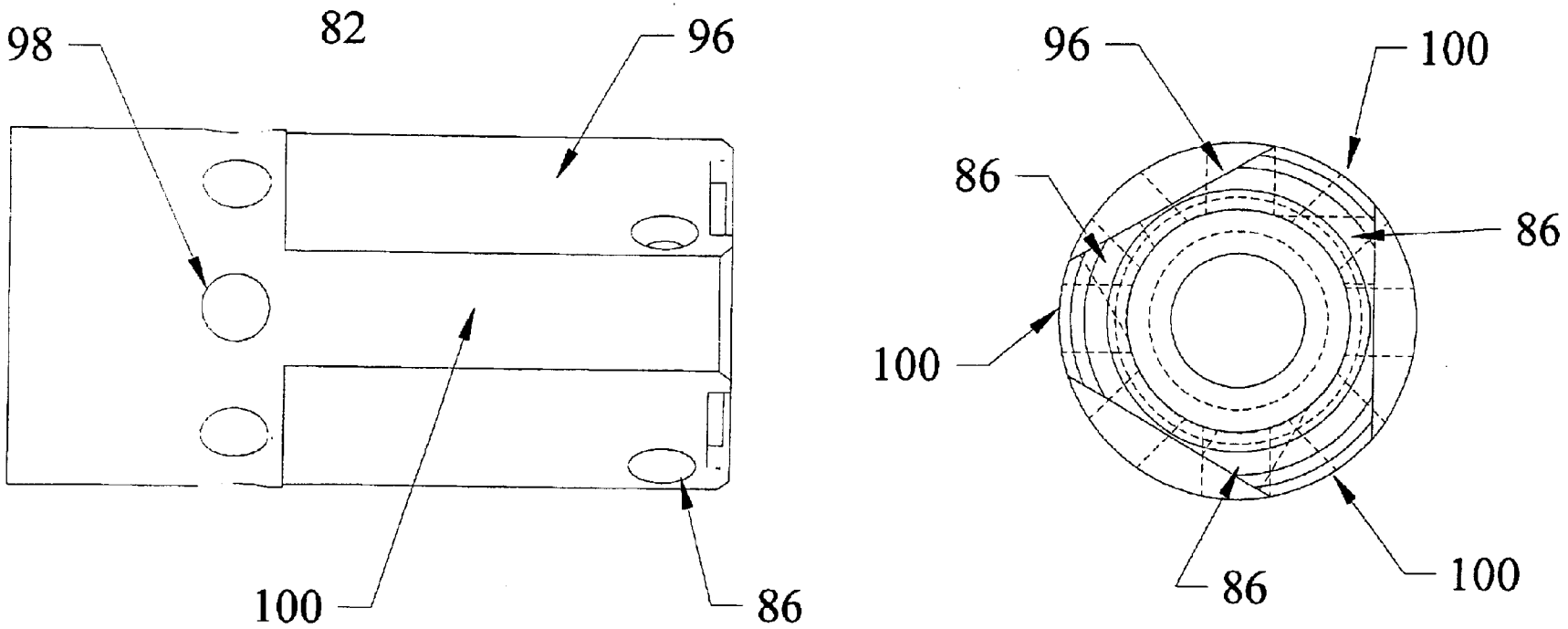
FIG. 5 shows an enlargement of the stream divider 82 of FIG. 4.

Atomizing air feeds into the air chamber 70 formed by the nozzle body 56, the water tube 58, the stream divider 82 and the air cap 60 through the atomizing air inlet 30. The atomizing air in the air chamber 70 is then separated into three different flow streams by using the air divider 82. One of the streams passing through the holes 98 (shown in FIG. 5) drilled towards the central axis of the cylindrical air divider 82 gets into the chamber 80 formed by the water tube 58 and the air divider 82. This stream then flows into the gap 72 between the divider 82 and the water tube 58 before enters the mixing chamber 74 to form the major air stream around the water tube 58.

There are three flat surfaces 96 (shown in FIG. 5) machined from the cylindrical outer surface of the air divider 82 and located on one end of the divider 82. The three flat surfaces are located 120° apart from each other. Three air channels 84 are formed between the three flat surfaces 96 on the air divider 82 and the inner surface of the air cap 60. All of the three channels 84 are connected to the air chamber 70. Atomizing air in channels 84 are used for the second and the third streams.

The second stream passes through the three holes 86 drilled off-center on the three flat surfaces 96 of the air divider 82 and flows tangentially into the mixing chamber 74. The three off-center holes 86 are aligned in such a way so that swirling flow is produced in the mixing chamber 74 around the major air stream. The orifice size of the three holes 86 and the air pressure in chamber 70 determine the strength of the swirl in the mixing chamber 74. The swirl determines the spray pattern of the final jet, especially the width of the final jet. Three off-center holes 86 are disclosed herein only for illustrative purposes. Any number of holes 86 other than three can be used as long as a swirl is created within the mixing chamber 74.

The third stream is generated by atomizing air in the three air channels 84 passing through the gap 76 formed between the air cap 60 and the air divider 82. A groove 88 is machined to connect the three air channels 84 together and produce a uniform stream all around the gap 76. The third stream passes through the gap 76, bends towards the chamfered surface 90 on the air cap 60 due to the Coanda effect. The Coanda effect indicates that flow tends to attach to a solid surface. The third stream wraps the swirling flow and the major stream within it in the mixing chamber 74. The combination of the three streams rushes out of the annulus 78 around the water jet emitting from nozzle orifice 26.

There are several benefits associated with the third stream of the present invention. One of the benefits is the efficiency of the atomizing nozzle. When the third stream bends at the chamfer 90 of the air cap 60, an area with low pressure is created near the chamfer 90 of the air cap 60 also due to the Coanda effect. This low pressure in chamber 74 created by the third stream reduces the resistance on both the major stream and the swirling second stream. The reduction of the resistance suggests that exactly the same spray pattern (particle size and mass profile) can be achieved with relatively low atomizing air source pressure. The resulting efficiency increase from this nozzle design reduces the load on the fan or compressor that supplies the compressed atomizing air. The saving is significant considering that a single rewet shower uses as many as 100 nozzles or even more.

Another benefit from the third stream is the parameter it adds that allows control of the two slopes of the water mass profile generated by the nozzle. The third stream adds axial momentum to the outer region of the swirl which steepens the two slopes on the outer edges of the profile and makes the profile more close to an ideal square in shape as is shown in FIG. 1 by the profile labeled Stream-Swirl-Stream Combination.

Yet another benefit from the third stream arises from the extra shearing force added to the mixed atomizing air. Larger water particles in the swirl move away from the center of the jet faster due to the greater centrifugal force. The shearing force created in the mixing range of the third stream and the swirl breaks those particles into even smaller particles. The resulting spray has a more uniform particle size distribution across the whole profile due to the contribution of the third stream.

Yet another benefit of the third stream is also efficiency related. The swirl generated by the three off-center holes 86 in the mixing chamber 74 is compressed in the convergent area formed by the chamfer 90 on the air cap 60. The tangential velocity in the swirl increases dramatically during the compression. The chamfer 90 of the air cap 60 drags the tangential velocity to zero on the chamfer surface. The friction on the chamfer surface dissipates the strength of the swirl and causes inefficiency in the nozzle. The third stream located between the swirl and the chamfer surface serves as an air cushion for the swirl and preserves the vortical strength of the swirl.

The air divider 82 is also used to maintain the concentricity of the water stream and the three air streams. Water tube 58 is mounted against the inside diameter of the air divider 82, so that the width of the gap 72 between the water tube 58 and the air divider 82 is the same in all directions. The three cylindrical surfaces 100 separated by the three flat surfaces 96 on the air divider 82 are slide fitted into the inside diameter of the air cap 60. The relatively tight tolerance at those two fittings among the water tube 58, the air divider 82 and the air cap 60 is required to keep the annulus 78 precisely around the water orifice 26. With the combination of the three atomizing air streams and the concentricity of all air streams and water stream, a spray pattern is produced. The water particle size is almost the same everywhere in the spray. More importantly, the resulting water mass profile is adjustable.

The three-stream nozzle of the present invention has an important and useful feature. The mass profile produced by the nozzle can be tailored into a shape that is most suitable for a specific application.

Paper makers may ask for a larger zone size in an air-water spray system to reduce the total cost of that system. A larger zone size implies a wider mass profile or larger spray angle from a single nozzle. The three-stream nozzle can produce a wider spraying by applying a stronger swirl into the nozzle. Fundamentally, a stronger swirl suggests a larger tangential velocity at the nozzle exit 78 as compared to a constant axial velocity at the same location. There are several ways to achieve the higher ratio of the tangential velocity to the axial velocity. The easiest way is to reduce the size of the off-center orifice 86 or the total number of the off-center orifices.

When the swirling flow in the three-stream nozzle is too strong, a recess in the middle of the mass profile may result from the fact that most droplets are thrown away from the center of the spray by the swirl. The gap 72 formed between the water tube 58 and the gas divider 82 can be opened to allow more axial (or straight) flow in the inner portion of the swirling stream. Opening the gap 72 reduces the tangential to axial velocity ratio near the center of the spray and consequently reduces the radial spreading of the droplets around the center. The resulting mass profile can be quite flat in the middle portion.

Paper makers may also ask for a smaller zone size to increase the resolution of the rewet shower. This application requires an atomizing nozzle with a relatively weak swirling flow in the mixed atomizing stream. The easiest way to reduce the swirling flow is to enlarge the size of the off-center orifice 86. When the swirling flow is weak, there are chances that the resulting mass profile has a peaky middle portion. To flatten the middle portion of the mass profile, the gap 72 should be reduced. The extreme case is that the gap 72 reduces to zero, and becomes an extra support that helps to maintain the concentricity of the mixed atomizing stream and the water stream.

Another concern of paper makers is the zone coupling between adjacent zones. The amount of zone coupling is a function of the slopes of the mass profile produced by a single nozzle. Gentle slopes create large zone coupling while steep slopes result in small coupling between adjacent zones. If the mass profile has a perfect square shape, the zone coupling is zero. By using the three-stream nozzle of the present invention, the amount of zone coupling is adjustable by adjusting the third stream in the mixed atomizing gas stream. Increasing the gap 76 formed between the nozzle cap 60 and the gas divider 82 steepens the slopes of the resulting mass profile, and consequently reduces the amount of zone coupling. Vice versa, reducing the gap 76 results in gentle slopes and a large amount of zone coupling.

As those of ordinary skill in the art can appreciate, the three-stream atomizing nozzle of the present invention can have other applications where the need exists for a controllable water spray, both in particle sizes and mass profile.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. Apparatus for atomizing a liquid with a gas comprising:

a) a housing having a gas discharging outlet and a liquid discharging outlet aligned flush with each other;

b) a first nozzle in said housing for producing at said gas discharging outlet and along a predetermined axis a mixed gas stream that is the combination of a gas stream that has a swirling movement around said predetermined axis, a first gas stream moving straight in the direction of said axis in the inner portion of said swirling stream and a second gas stream also moving straight in the direction of said axis and wrapping around said swirling stream and said first gas stream;

c) a second nozzle disposed in said first nozzle for producing at said liquid discharging outlet a controlled stream of liquid; and d) a gas stream divider disposed in said first nozzle and outside of said second nozzle, said gas stream divider maintaining the concentricity of said mixed gas stream and said controlled liquid stream.

2. The apparatus of claim 1 further comprising a chamber for mixing said swirling stream, said first and said second straight streams to produce said mixed gas stream.

3. The apparatus of claim 1 where said gas stream divider divides a gas stream entering said first nozzle into said swirling gas stream and said first and said second gas streams.

4. Apparatus for atomizing a liquid with a gas comprising:

a) a first nozzle for producing in said apparatus and along a predetermined axis a mixed gas stream that is the combination of a gas stream that has a swirling movement around said predetermined axis, a first gas stream moving straight in the direction of said axis in the inner portion of said swirling stream and a second gas stream also moving straight in the direction of said axis and wrapping around said swirling stream and said first gas stream;

b) a second nozzle disposed in said first nozzle for producing in said apparatus a controlled stream of liquid; and c) a gas stream divider disposed in said first nozzle and outside of said second nozzle, said gas stream divider maintaining the concentricity of said mixed gas stream and said controlled liquid stream.

5. The apparatus of claim 4 further comprising a chamber for mixing said swirling stream, said first and said second straight streams to produce said mixed gas stream.

6. The apparatus of claim 4 where said gas stream divider divides a gas stream entering said first nozzle into said swirling gas stream and said first and said second gas streams.

7. The apparatus of claim 4 further comprising a housing having a gas discharging outlet and a liquid discharging outlet aligned flush with each other, said mixed gas stream produced at said gas discharging outlet and said liquid stream produced at said liquid discharging outlet.

8. In a nozzle, a method for atomizing a liquid with a gas comprising:

(a) forming a mixed gas stream that is the combination of a gas stream that has a swirling movement about a predetermined axis, one gas stream moving straight in the direction of said axis in the inner portion of said swirling stream and another gas stream also moving straight in the direction of said axis said another gas stream wrapping around said swirling stream and said one straight gas stream; and (b) supplying a flow of liquid into said formed gas stream so that the flow of liquid is atomized by said mixed gas stream.

9. The method of claim 8 further comprising the step of emitting said liquid atomized by said formed gas stream from said nozzle.

10. The method of claim 9 wherein said liquid atomized by said formed gas stream is received by a web of hygroscopic material that advances across said emitted atomized liquid.

11. The method of claim 8 further comprising the step of adjusting at least one of said swirling gas stream, said one gas stream and said another gas stream in said mixed gas stream so that said atomized liquid flow has a predetermined mass distribution profile.

12. A method for atomizing a liquid with a gas comprising:

(a) forming a mixed gas stream that is the combination of a gas stream that has a swirling movement about a predetermined axis, one gas stream moving straight in the direction of said axis in the inner portion of said swirling stream and another gas stream also moving straight in the direction of said axis said another gas stream wrapping around said swirling stream and said one straight gas stream;

(b) atomizing a flow of liquid with said formed gas stream to produce fine droplets of said liquid; and (c) adjusting at least one of said swirling gas stream, said one gas stream and said another gas stream in said mixed gas stream so that said droplets have a predetermined mass distribution profile.

13. In a nozzle for atomizing a liquid with a gas, said nozzle having an outlet, said nozzle comprising:

(a) a gas stream divider for dividing a gas stream entering said nozzle into a swirling gas stream that has a swirling movement about a predetermined axis, one gas stream moving straight in the direction of said axis in the inner portion of said swirling stream and another gas stream also moving straight in the direction of said axis; and (b) a chamber for mixing said swirling stream, said one straight stream and said another straight stream to produce in said nozzle a mixed gas stream that is the combination of said swirling stream, said one straight gas stream and said another straight gas stream, said another straight gas stream wrapping around said swirling stream and said one straight gas stream.

14. The nozzle of claim 13 wherein said gas stream divider maintains the concentricity of a liquid stream in said nozzle and said mixed gas stream at said nozzle outlet.

15. An apparatus comprising:

an array of nozzles for atomizing a liquid with a gas, each of said nozzles having an outlet and each of said nozzles comprising:

(i) a gas stream divider for dividing a gas stream entering said nozzle into a gas stream that has a swirling movement about a predetermined axis, one gas stream moving straight in the direction of said axis in the inner portion of said swirling stream and another gas stream also moving straight in the direction of said axis; and (ii) a chamber for mixing said swirling stream, said one straight stream and said another straight stream to produce in said nozzle a mixed gas stream that is the combination of said swirling stream, said one straight gas stream and said another straight gas stream, said another straight gas stream wrapping around said swirling stream and said one straight gas stream.

16. The apparatus of claim 15 wherein said swirling gas stream in each of said nozzles in said array swirl in the same direction.

17. The apparatus of claim 15 wherein said swirling gas stream in each of any two of said nozzles adjacent to each other in said array swirl in opposite directions.

18. The apparatus of claim 15 wherein in each of said nozzles in said array said gas stream divider maintains the concentricity of a liquid stream in said nozzle and said mixed gas stream at said nozzle outlet.

19. The apparatus of claim 15 wherein said array of nozzles is used to wet a web of hygroscopic material.

20. The apparatus of claim 15 wherein in each of said nozzles a flow of liquid is supplied into said mixed gas stream so that said liquid flow is atomized by said mixed gas stream.

21. The apparatus of claim 20 wherein said atomized flow of liquid is emitted from each of said nozzles.

22. The apparatus of claim 21 wherein said atomized flow of liquid emitted from each of said nozzles is received by a web of hygroscopic material that advances across said array of nozzles.

23. An apparatus comprising:

an array of nozzles for atomizing a liquid with a gas, each of said nozzles having an outlet and each of said nozzles comprising:

(i) a gas stream divider for dividing a gas stream entering said nozzle into a gas stream that has a swirling movement about a predetermined axis, one gas stream moving straight in the direction of said axis in the inner portion of said swirling stream and another gas stream also moving straight in the direction of said axis;

(ii) a chamber for mixing said swirling stream, said one straight stream and said another straight stream to produce in said nozzle a mixed gas stream that is the combination of said swirling stream, said one straight gas stream and said another straight gas stream, said another straight gas stream wrapping around said swirling stream and said one straight gas stream; and (iii) a flow of liquid atomized by said mixed gas stream; and a web of a hygroscopic material advancing across said array of nozzles.

* * * * *